US010766289B2

(12) United States Patent
Kobayashi et al.

(10) Patent No.: US 10,766,289 B2
(45) Date of Patent: Sep. 8, 2020

(54) CLOTH HOLDER, FABRIC PRINTING APPARATUS, AND HEATING DEVICE

(71) Applicant: Ricoh Company, Ltd., Tokyo (JP)

(72) Inventors: Takeyuki Kobayashi, Kanagawa (JP); Yoshinori Uchino, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 426 days.

(21) Appl. No.: 15/834,189

(22) Filed: Dec. 7, 2017

(65) Prior Publication Data

US 2018/0170087 A1 Jun. 21, 2018

(30) Foreign Application Priority Data

Dec. 19, 2016 (JP) ..... 2016-245427
Oct. 23, 2017 (JP) ..... 2017-204326

(51) Int. Cl.
*B41J 3/407* (2006.01)
*B41J 11/06* (2006.01)
*B41M 7/00* (2006.01)

(52) U.S. Cl.
CPC ..... *B41M 7/009* (2013.01); *B41J 3/4078* (2013.01); *B41J 11/06* (2013.01)

(58) Field of Classification Search
CPC ..... B41J 3/28; B41J 3/36; B41J 3/4078; B41J 11/007; B41J 11/06; B41J 11/58; B41J 13/10; B41M 7/009; B41M 7/0047; B41F 15/18; B41F 17/005; D06P 5/30; H04N 1/54; G03G 15/6502; G03G 15/6591; G03G 2215/00527; G03G 2215/2019
See application file for complete search history.

(56) References Cited

U.S. PATENT DOCUMENTS 7,954,921 B2 * 6/2011 Ben-Zur et al. ..... B41J 2/015 347/21
9,073,369 B2 * 7/2015 Yanagishita ..... B41J 11/00 347/104
2013/0104762 A1 * 5/2013 Yanagishita ..... B41F 1/28 101/407.1
2013/0340640 A1 * 12/2013 Yanagishita ..... B41F 17/00 101/474
2014/0210901 A1 * 7/2014 Ohashi et al. ..... D06P 5/30 347/20
2017/0320316 A1 11/2017 Nakamura et al.
2017/0320339 A1 11/2017 Matsumoto et al.

FOREIGN PATENT DOCUMENTS

JP 2013-096017 5/2013
JP 2017-200743 11/2017

* cited by examiner

*Primary Examiner* — Anh T Vo
(74) *Attorney, Agent, or Firm* — Xsensus LLP

(57) ABSTRACT

A cloth holder includes a base and a platen to hold a cloth. The platen is movable and includes a flange. A flange cover sandwiches the cloth together with the flange of the platen. The flange cover includes a supported end in a longitudinal direction of the cloth holder that is pivotally supported by the base. The flange cover is opened and closed relative to the base. A cloth stretcher stretches the cloth placed on the platen while the flange cover is moved.

18 Claims, 15 Drawing Sheets

CLOTH HOLDER, FABRIC PRINTING APPARATUS, AND HEATING DEVICE

CROSS-REFERENCE TO RELATED APPLICATIONS

This patent application is based on and claims priority pursuant to 35 U.S.C. § 119 to Japanese Patent Application Nos. 2016-245427, filed on Dec. 19, 2016, and 2017-204326, filed on Oct. 23, 2017, in the Japanese Patent Office, the entire disclosure of each of which is hereby incorporated by reference herein.

BACKGROUND

Technical Field

Exemplary aspects of the present disclosure relate to a cloth holder, a fabric printing apparatus, and a heating device, and more particularly, to a cloth holder for holding fabric, a fabric printing apparatus for printing an image on fabric, and a heating device for heating the image on the fabric.

Description of the Background

Related-art fabric printing apparatuses, such as a fabric printer, print on fabric. The fabric printer includes a support device that supports fabric (e.g., a cloth) onto which an image is formed. The support device includes a holder, a base, and a print face former. The holder is inserted into a tubular body formed by the cloth to hold the cloth. The holder fits in the base in a state in which the holder holds the cloth. The print face former is disposed on at least one of the holder and the base. The print face former defines a print face of the cloth onto which ink is discharged in a state in which the holder fits in the base.

However, the support device uses the cloth that has the tubular body. Since one end of the holder is rotatably attached to the base, while the holder covered by the tubular body of the cloth is fitted in the base, the cloth may crease. Accordingly, a user may reset the cloth on the holder repeatedly, degrading usability of the support device.

SUMMARY

This specification describes below an improved cloth holder. In one embodiment, the cloth holder includes a base and a platen to hold a cloth. The platen is movable and includes a flange. A flange cover sandwiches the cloth together with the flange of the platen. The flange cover includes a supported end in a longitudinal direction of the cloth holder that is pivotally supported by the base. The flange cover is opened and closed relative to the base. A cloth stretcher stretches the cloth placed on the platen while the flange cover is moved.

This specification further describes an improved fabric printing apparatus. In one embodiment, the fabric printing apparatus includes a body, a cloth holder, and a receiver. The cloth holder includes a base and a platen to hold a cloth. The platen is movable and includes a flange. A flange cover sandwiches the cloth together with the flange of the platen. The flange cover includes a supported end in a longitudinal direction of the cloth holder that is pivotally supported by the base. The flange cover is opened and closed relative to the base. A cloth stretcher stretches the cloth placed on the platen while the flange cover is moved. The receiver is disposed inside the body and removably receives the cloth holder.

This specification further describes an improved heating device. In one embodiment, the heating device heats a cloth bearing an image printed by a fabric printing apparatus. The heating device includes a body, a cloth holder, and a receiver. The cloth holder includes a base and a platen to hold a cloth. The platen is movable and includes a flange. A flange cover sandwiches the cloth together with the flange of the platen. The flange cover includes a supported end in a longitudinal direction of the cloth holder that is pivotally supported by the base. The flange cover is opened and closed relative to the base. A cloth stretcher stretches the cloth placed on the platen while the flange cover is moved. The receiver is disposed inside the body and removably receives the cloth holder.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
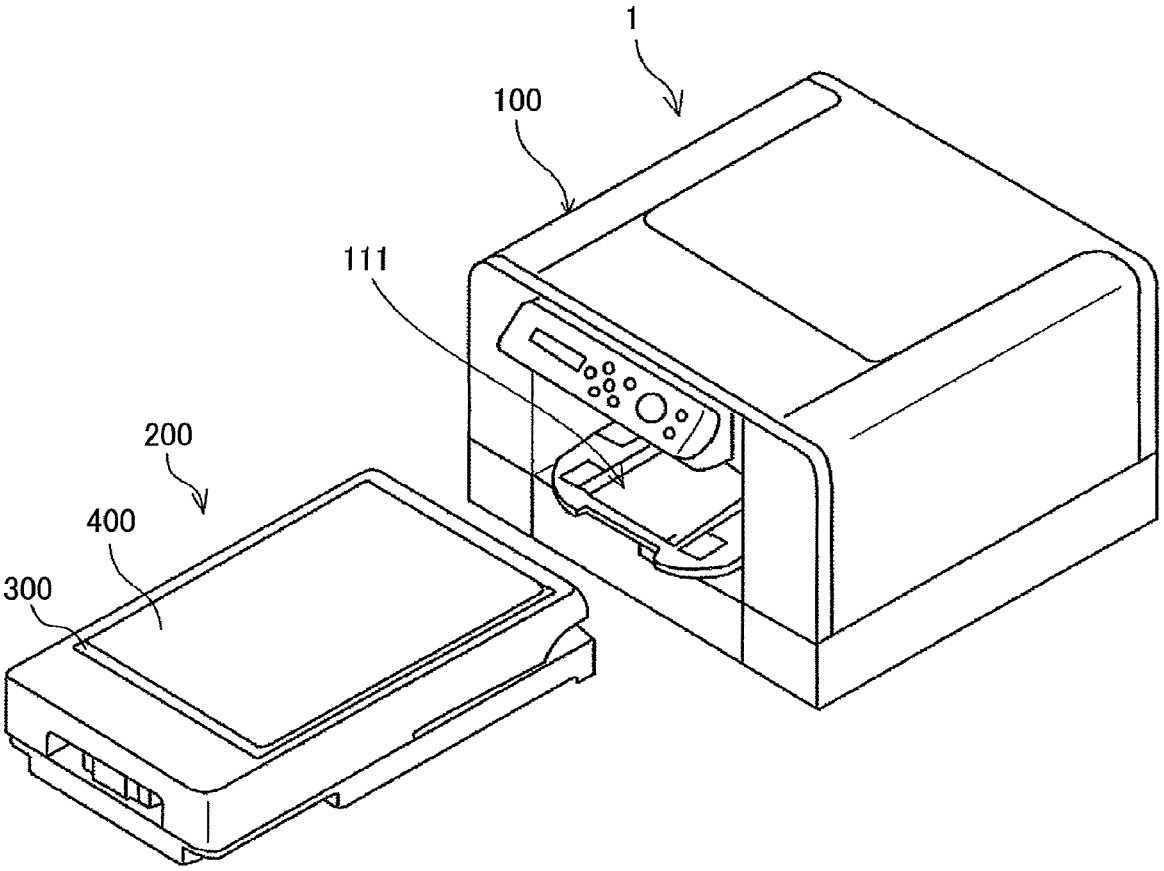
FIG. 1 is an external perspective view of a printer according to an embodiment of the present disclosure, illustrating a cassette removed from the printer.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

Referring to FIGS. 1 to 4, a description is provided of a construction of a printer 1 according to a first embodiment of the present disclosure.

Figure 2:
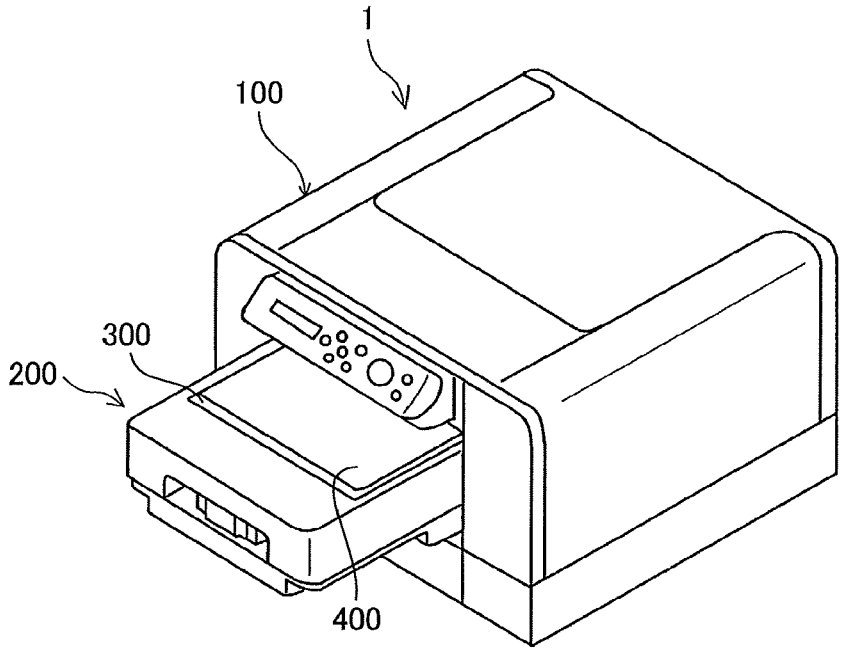
FIG. 2 is an external perspective view of the printer depicted in FIG. 1 attached with the cassette.
Figure 3:
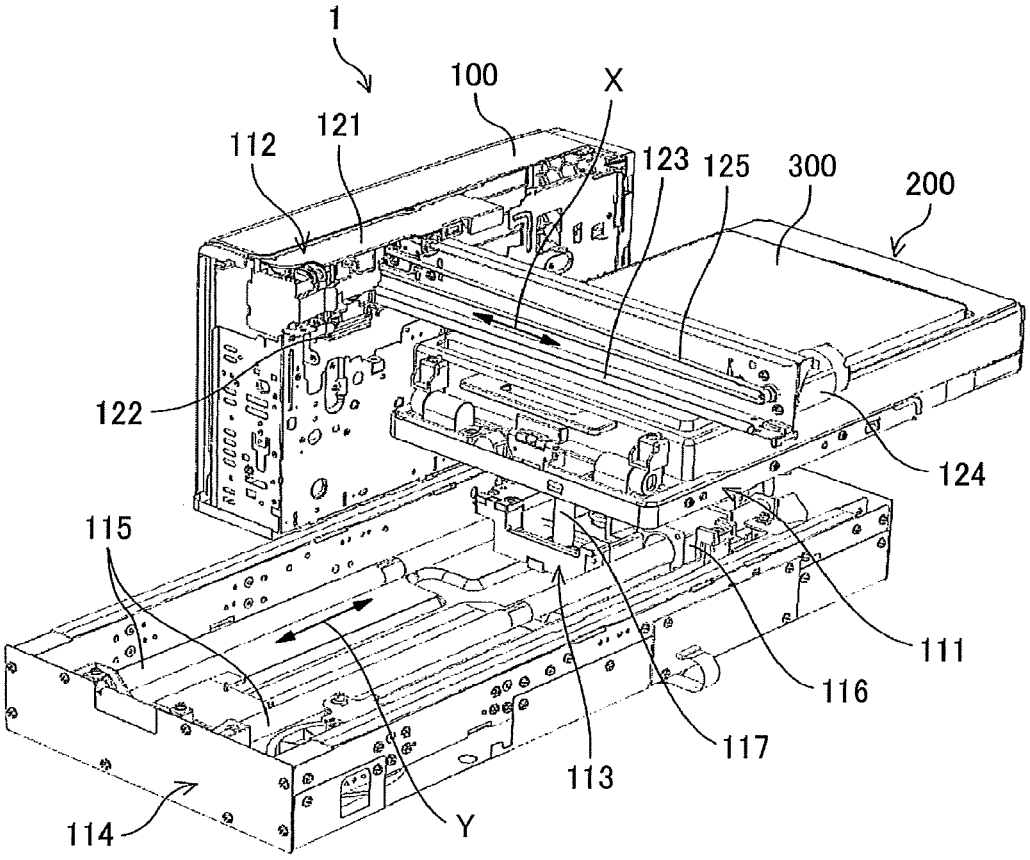
FIG. 3 is an internal perspective view of the printer depicted in FIG. 2, illustrating an entire mechanical section thereof seen from a first direction.
Figure 4:
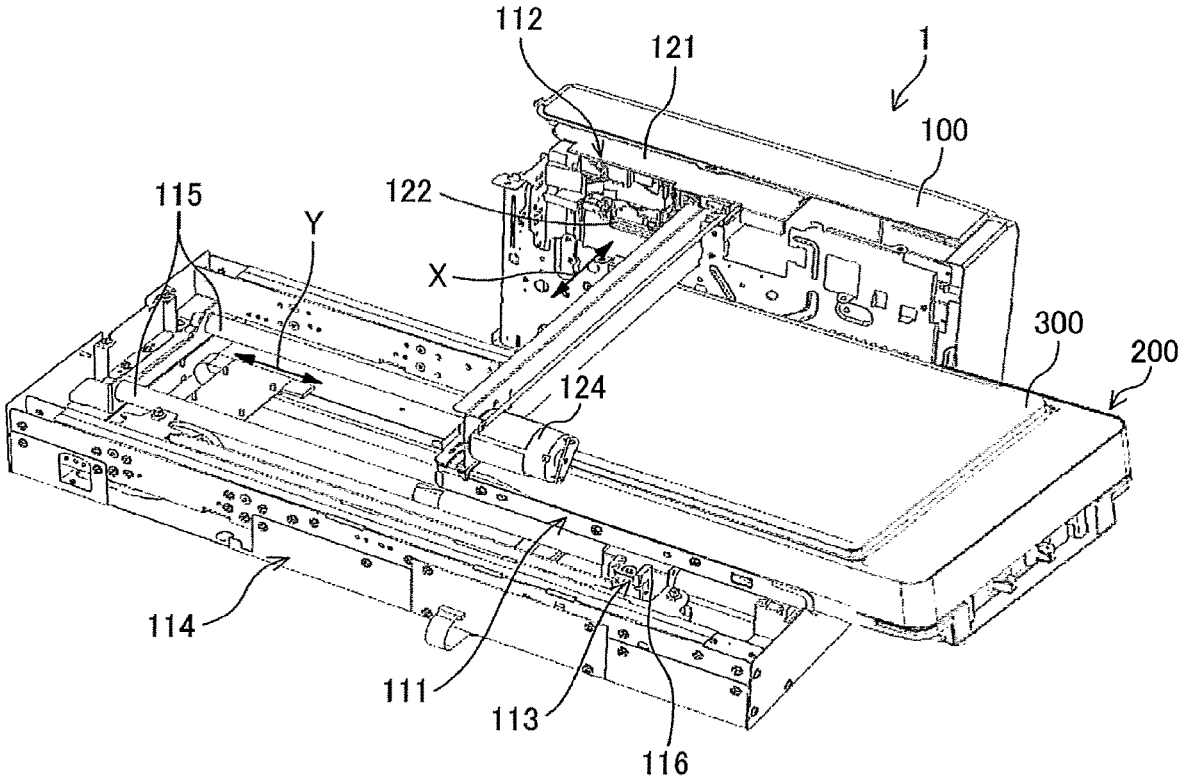
FIG. 4 is an internal perspective view of the printer depicted in FIG. 3, illustrating the entire mechanical section thereof seen from a second direction different from the first direction in FIG. 3.

The printer 1 is a fabric printer serving as a fabric printing apparatus that prints on fabric. FIG. 1 is an external perspective view of the printer 1 and a cassette 200 serving as a cloth holder removed from the printer 1. FIG. 2 is an external perspective view of the printer 1 attached with the cassette 200. FIG. 3 is an internal perspective view of the printer 1, illustrating an entire mechanical section thereof seen from a first direction. FIG. 4 is an internal perspective view of the printer 1, illustrating the entire mechanical section thereof seen from a second direction different from the first direction in FIG. 3.

As illustrated in FIGS. 1 to 4, the printer 1 serving as a fabric printing apparatus includes a body 100. Inside the body 100 are the cassette 200, a stage 111, and a printing device 112. As illustrated in FIG. 1, the cassette 200 serving as a cloth holder is a tray that holds a cloth 400. The stage 111 serves as a receiver that removably receives and holds the cassette 200 and is movable back and forth. As illustrated in FIG. 3, the printing device 112 prints an image on the cloth 400 placed on the cassette 200 held by the stage 111.

For example, the cloth 400 includes a piece of cloth such as a handkerchief and towel, a fabric manufactured as clothes such as a T-shirt and a sweatshirt, and a fabric used as a part of a product such as a tote bag.

As illustrated in FIG. 3, the stage 111 is disposed above a conveyer 113 movably supported by the body 100 such that the conveyer 113 is movable in a direction Y in a feed direction. The body 100 includes a bottom frame 114 that mounts a conveyance guide 115 along the direction Y. The conveyance guide 115 movably supports a slider 116 of the conveyer 113. The stage 111 is disposed on the conveyer 113 through a rod 117 that lifts and lowers the stage 111. Thus, a gap between the stage 111 and a head 122 of the printing device 112 is adjusted.

The printing device 112 includes a carriage 121 and the head 122. The carriage 121 moves relative to the stage 111 in a direction X, that is, a main scanning direction. The head 122 is mounted on the carriage 121. The carriage 121 is movably supported by a guide 123 extending in the direction X. A driving motor 124 reciprocally moves the carriage 121 in the direction X via a main scanning mechanical section such as a timing belt 125. The head 122 is a liquid discharge head that discharges ink onto a surface of the cloth 400 to form an image on the cloth 400. Alternatively, other types of heads may be employed as the head 122.

The cassette 200 includes a platen 300 on which the cloth 400 is placed. The cassette 200 mounting the cloth 400 is attached to the stage 111 that holds the cassette 200 inside the body 100. As the stage 111 moves in the direction Y and the head 122 reciprocally moves in the direction X repeatedly, the head 122 prints a desired image on the cloth 400.

Figure 5:
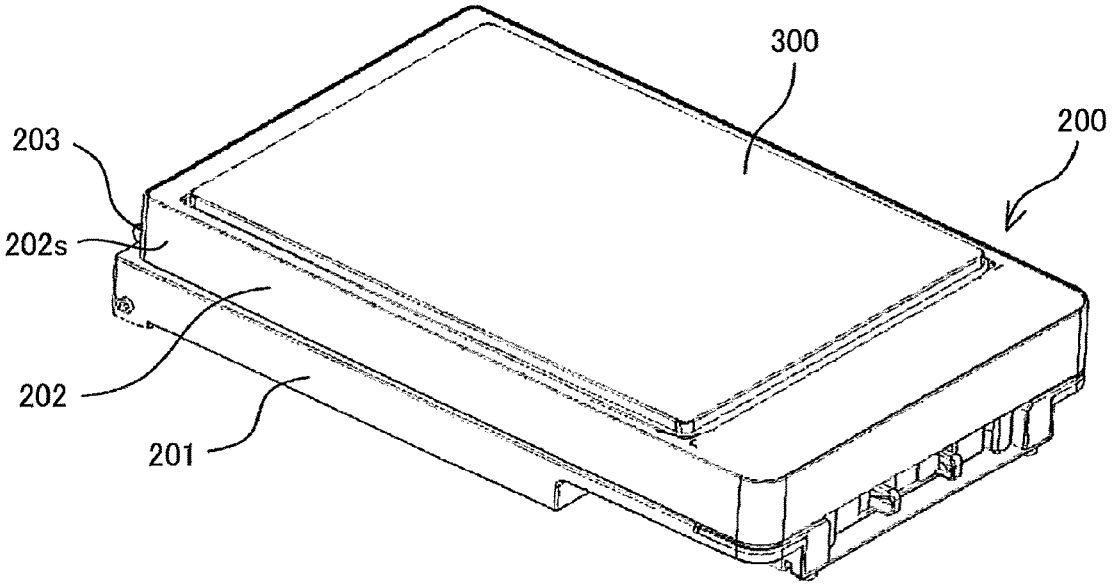
FIG. 5 is a perspective view of the cassette depicted in FIG. 1.
Figure 6:
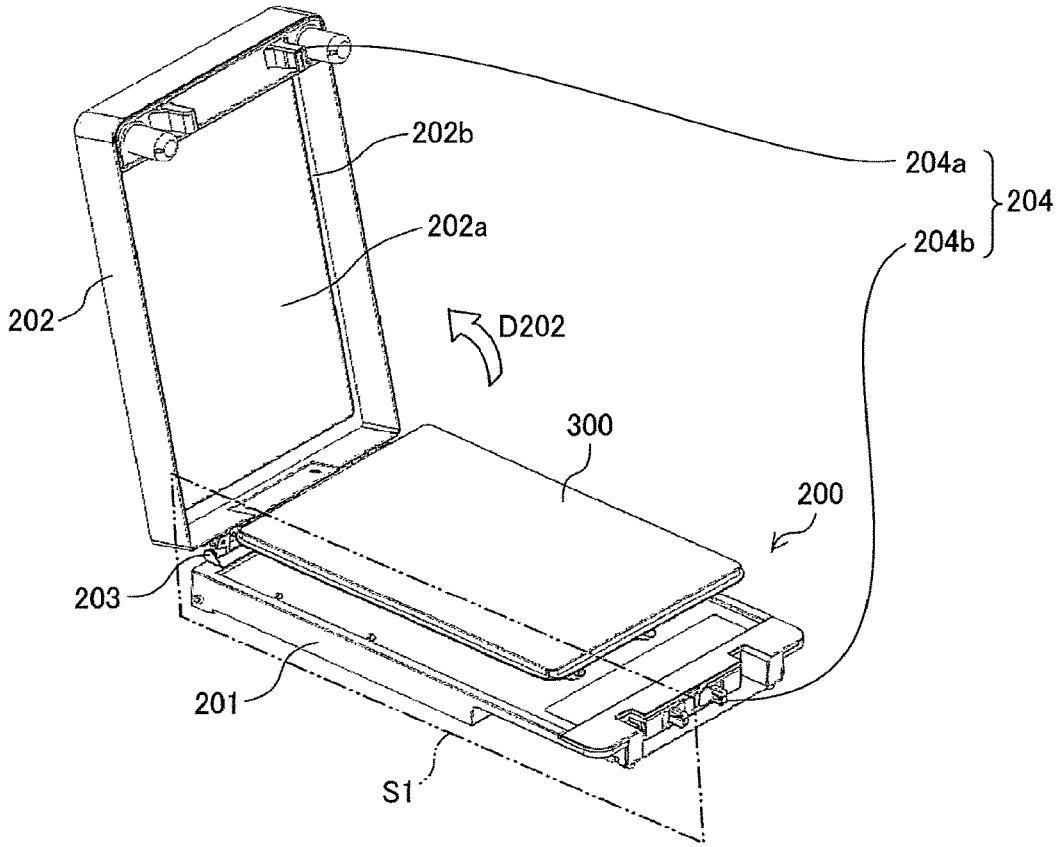
FIG. 6 is a perspective view of the cassette depicted in FIG. 5, illustrating a platen flange cover that is lifted.
Figure 7:
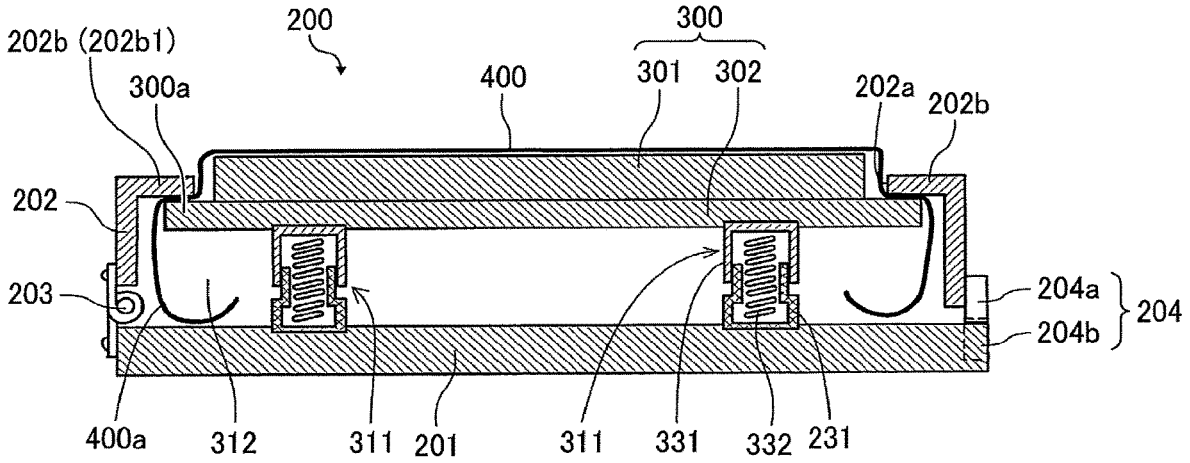
FIG. 7 is a schematic cross-sectional view of the cassette depicted in FIG. 5 in a longitudinal direction thereof taken on a cross-section in FIG. 6.

Referring to FIGS. 5 to 7, a description is provided of a construction of the cassette 200 (e.g., a tray) serving as a cloth holder.

FIG. 5 is a perspective view of the cassette 200. FIG. 6 is a perspective view of the cassette 200, illustrating a platen flange cover 202 that is lifted. FIG. 7 is a schematic cross-sectional view of the cassette 200 in a longitudinal direction thereof taken on a cross-section S1 in FIG. 6.

As illustrated in FIG. 5, the cassette 200 includes a cassette base 201 serving as a base and the platen 300 that holds the cloth 400 and keeps a print portion of the cloth 400 where the image is printed to be planar.

As illustrated in FIG. 7, the platen 300 includes a platen base 302 and an insulator 301 that includes a mount face that mounts the cloth 400 and keeps the cloth 400 to be planar. The insulator 301 is resistant against heat generated by a heating device.

As illustrated in FIGS. 5 and 6, the cassette 200 includes the platen flange cover 202 and a hinge 203. One end, that is, a supported end 202*s* of the platen flange cover 202 serving as a flange cover in the longitudinal direction of the cassette 200 is pivotally attached to and supported by the cassette base 201 through the hinge 203. Thus, as illustrated in FIG. 6, the platen flange cover 202 is lifted relative to the cassette base 201 in a direction D202.

As illustrated in FIG. 6, the platen flange cover 202 includes a frame 202*b* defining a slot 202*a*, that is, an opening, disposed opposite the platen 300. As illustrated in FIG. 7, the platen 300 includes a flange 300*a* disposed at a rim of the platen 300. The frame 202*b* of the platen flange cover 202 presses the cloth 400 against the flange 300*a* of the platen 300.

A plurality of supports 311 mounted on the cassette base 201 supports the platen 300. The platen 300 and the cassette base 201 define an accommodation chamber 312 (e.g., an accommodation space) that accommodates a surplus portion 400*a* of the cloth 400. For example, the surplus portion 400*a* may be sleeves, a neck, a hem, and the like of a T-shirt, if an image is printed on a front of the T-shirt.

The platen 300 is removably attached to the cassette base 201 and is replaceable. Accordingly, a plurality of platens 300 may be used for printing. While a first platen 300 is used for a print job, a user wraps a cloth 400 (e.g., a garment) around a second platen 300 to be used for a next print job. After the print job and a fixing job are finished, the first platen 300 is replaced with the second platen 300 to start the next print job quickly.

In order to set the cloth 400 on the cassette 200, the user lifts and opens the platen flange cover 202 as illustrated in FIG. 6 and places the cloth 400 on the platen 300. In a state in which the accommodation chamber 312 accommodates the surplus portion 400*a* of the cloth 400 as illustrated in FIG. 7, the user lowers and closes the platen flange cover 202 as illustrated in FIG. 5.

In order to cause the printer 1 to print on the cloth 400, the user attaches or sets the cassette 200 mounting the cloth 400 onto the stage 111 disposed inside the body 100 of the printer 1 as illustrated in FIG. 4.

As described above, the user removes the cassette 200 entirely from the body 100 and sets the cloth 400, onto which the image is to be printed, on the platen 300 readily.

After the printer 1 finishes printing on the cloth 400, the user moves the cassette 200 mounting the cloth 400 from the printer 1 to the heating device and sets the cassette 200 inside the heating device. The heating device fixes the image on the cloth 400 under heat.

As illustrated in FIG. 7, each of the supports 311 that supports the platen 300 includes a plurality of hollow columns 231 and 331 and a compression spring 332. The hollow column 231 is mounted on the cassette base 201. The hollow column 331 contacts the platen 300 and movably engages the hollow column 231. The compression spring 332 is disposed between or housed by the hollow columns 231 and 331.

Thus, the supports 311 support the platen 300 such that the platen 300 is displaceable or movable relative to the cassette base 201 serving as a base.

The platen flange cover 202 mounts a lock claw 204*a*. The lock claw 204*a* is disposed at another end of the platen flange cover 202 in the longitudinal direction of the cassette 200, which is opposite the one end of the platen flange cover 202, which is held by the hinge 203 about which the platen flange cover 202 is pivotable relative to the cassette base 201.

The cassette base 201 is provided with a lock claw holder 204*b* that releasably holds the lock claw 204*a*. The lock claw 204*a* and the lock claw holder 204*b* construct a lock 204 that restricts the height of the platen flange cover 202 covering the flange 300*a* of the platen 300 relative to the cassette base 201.

Accordingly, when the thickness of the cloth 400 changes, the platen 300 lowers against a restoring force of the compression spring 332 to change a clearance between the platen 300 and the cassette base 201. Thus, the cassette 200 holds the clothes 400 of various thicknesses precisely.

Since the platen 300 is constantly pressed against the platen flange cover 202 with a constant force, even when the user carries the cassette 200, the cloth 400 does not shift or slip easily.

Additionally, even if the thickness of the cloth 400 changes, the platen 300 lowers to secure a clearance between the platen flange cover 202 and the platen 300. Accordingly, even if the thickness of the cloth 400 changes, the height of the platen flange cover 202 relative to the cassette base 201 does not change.

That is, the height of the surface of the cloth 400 held by the platen 300 is based on the height of the platen flange cover 202 relative to the cassette base 201.

A lock position where the lock 204 locks the platen flange cover 202 relative to the cassette base 201 is fixed, simplifying the construction of the cassette 200. Since the lock position does not change, the user operates the cassette 200 readily.

If a liquid discharge head is used as the head 122, as the distance from the head 122 to a surface of an object that receives liquid discharged from the head 122 decreases, the head 122 discharges the liquid onto the object more precisely to form an image with higher quality.

In this case, the platen 300 is displaceable or movable and the flange 300*a* of the platen 300 is pressed against the platen flange cover 202. Accordingly, even if the thickness of the cloth 400 changes, the platen flange cover 202 restricts the height of the surface of the cloth 400, improving quality of the image formed on the cloth 400.

If the platen 300 is configured to be displaceable or movable, in order to retain parallelism between a surface of the platen 300 and a surface of the head 122 as it moves, the support 311 preferably supports the platen 300 at the flange 300*a* of the platen 300. However, the support 311 may make it difficult for the accommodation chamber 312 to accommodate the surplus portion 400*a* of the cloth 400.

To address this circumstance, the height of the platen flange cover 202 defines the height of the surface of the cloth 400 held by the platen 300, allowing the support 311 to contact an inward portion of the platen 300 and decreasing the number of the supports 311. Accordingly, the accommodation chamber 312 accommodates the surplus portion 400*a* of the cloth 400 readily.

Referring to FIGS. 8, 9A, 9B, and 9C, a description is provided of a construction of a comparative cassette 200C.

Figure 8:
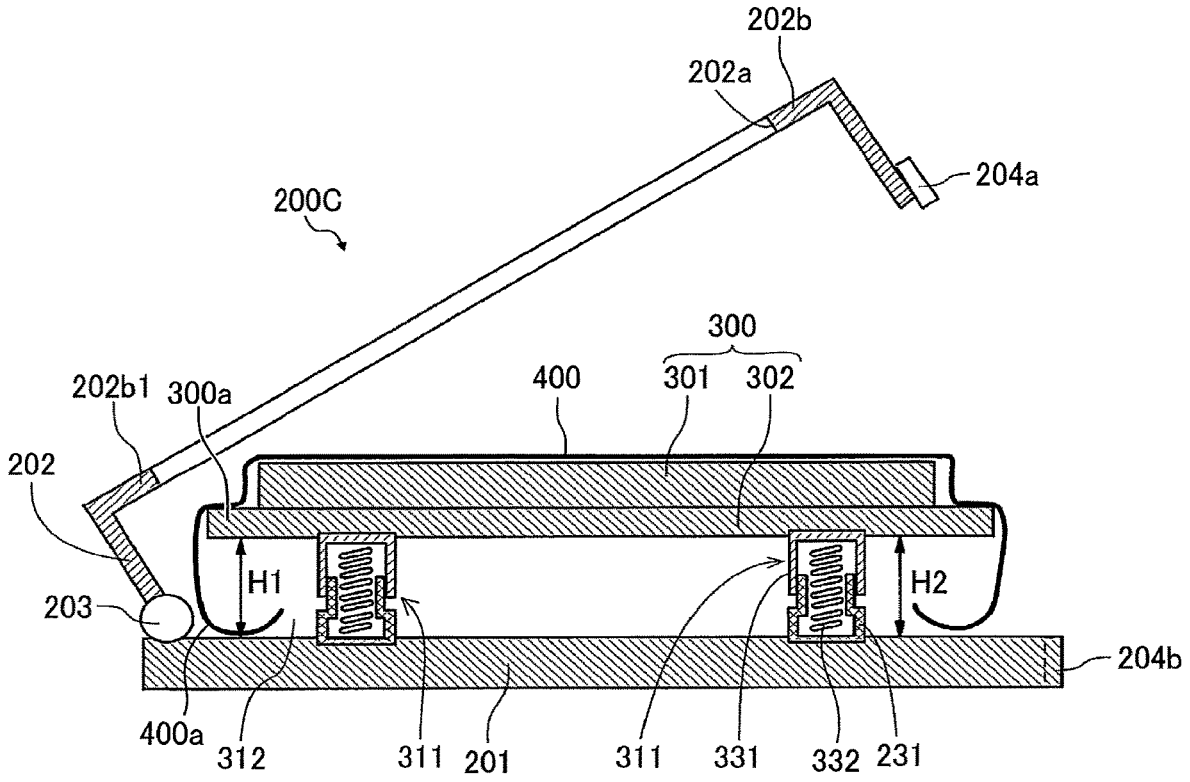
FIG. 8 is a schematic cross-sectional view of a comparative cassette in a longitudinal direction thereof, illustrating the platen flange cover that is lifted.
Figure 9A:
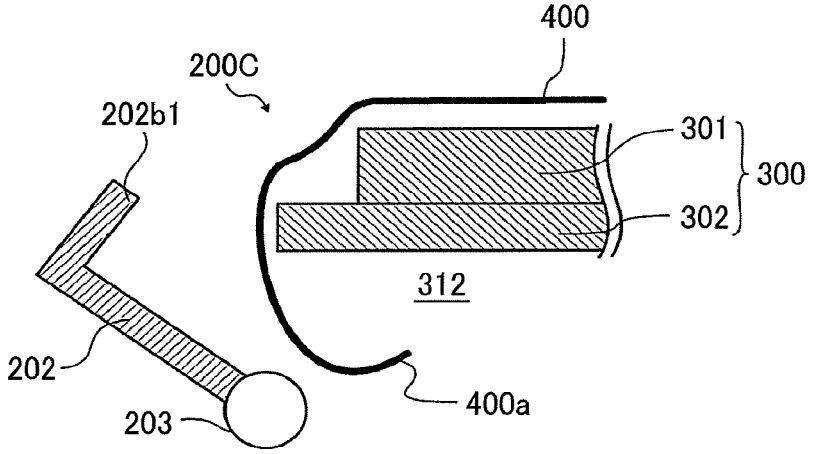
FIG. 9A is a partial cross-sectional view of the comparative cassette depicted in FIG. 8, illustrating a first position of the platen flange cover.
Figure 9B:
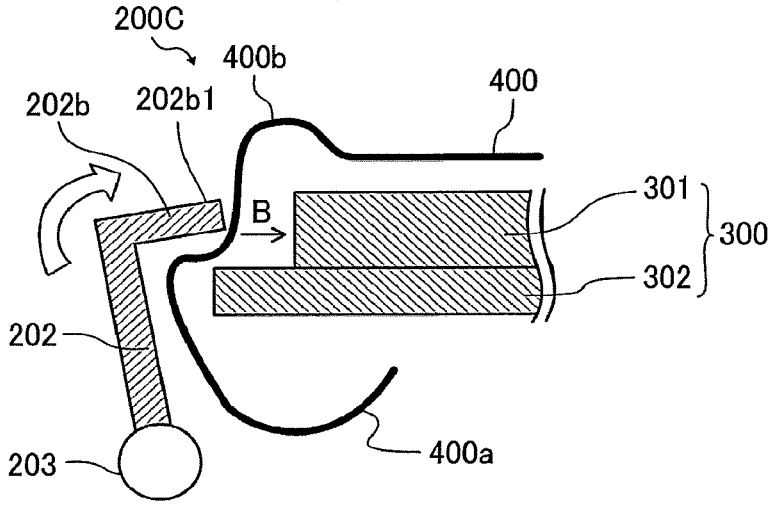
FIG. 9B is a partial cross-sectional view of the comparative cassette depicted in FIG. 8, illustrating a second position of the platen flange cover.
Figure 9C:
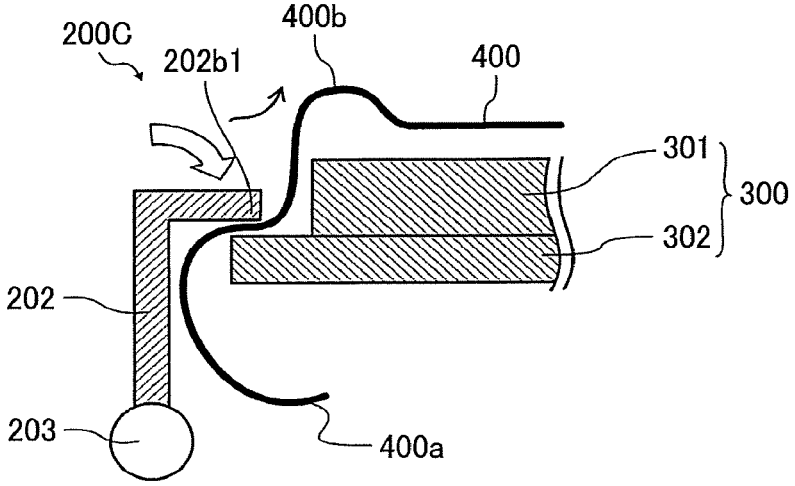
FIG. 9C is a partial cross-sectional view of the comparative cassette depicted in FIG. 8, illustrating a third position of the platen flange cover.

FIG. 8 is a schematic cross-sectional view of the comparative cassette 200C in a longitudinal direction thereof, illustrating the platen flange cover 202 that is lifted. FIG. 9A is a partial cross-sectional view of the comparative cassette 200C, illustrating a first position of the platen flange cover 202 moved for the user to set the cloth 400 on the platen 300. FIG. 9B is a partial cross-sectional view of the comparative cassette 200C, illustrating a second position of the platen flange cover 202 moved for the user to set the cloth 400 on the platen 300. FIG. 9C is a partial cross-sectional view of the comparative cassette 200C, illustrating a third position of the platen flange cover 202 moved for the user to set the cloth 400 on the platen 300. In FIGS. 9A, 9B, and 9C, identical reference numerals are assigned to components of the comparative cassette 200C that are equivalent to the components of the cassette 200 depicted in FIG. 7. The hinge 203 is simplified in FIGS. 9A, 9B, and 9C.

As illustrated in FIG. 8, while the platen flange cover 202 is lifted, the platen 300 retains parallelism with the cassette base 201. For example, a clearance H1 between the platen 300 and the cassette base 201 at one lateral end of the platen 300 and the cassette base 201 in a longitudinal direction thereof is equivalent to a clearance H2 between the platen 300 and the cassette base 201 at another lateral end of the platen 300 and the cassette base 201 in the longitudinal direction thereof. The thickness of the platen 300 in a direction perpendicular to the longitudinal direction thereof is substantially constant in the longitudinal direction of the platen 300.

With a configuration illustrated in FIG. 8 in which one end of the platen flange cover 202 in a longitudinal direction thereof is pivotally supported by the cassette base 201, the hinge 203 serving as a fulcrum about which the platen flange cover 202 pivots or rotates is preferably situated at a position lower than an upper face of the platen 300.

If the hinge 203 is disposed in proximity to the upper face of the platen 300 vertically, a clearance between the hinge 203 and the platen 300 decreases. Accordingly, when the user sets the cloth 400 having a great area on the platen 300, the user may not insert the cloth 400 into the accommodation chamber 312 below the platen 300 easily.

To address this circumstance, if the hinge 203 about which the platen flange cover 202 pivots is lower than the platen 300 vertically, when the user sets the cloth 400 on the platen 300, the cloth 400 is susceptible to creasing.

Referring to FIGS. 9A, 9B, and 9C, a description is provided of processes for setting the cloth 400 on the platen 300.

As illustrated in FIG. 9A, the user places the cloth 400 on the platen 300 and places the surplus portion 400*a* of the cloth 400 that protrudes from the platen 300 into the accommodation chamber 312 below the platen 300. In order to allow the user to place the surplus portion 400*a* of the cloth 400 into the accommodation chamber 312 readily, the hinge 203 is lower than the platen 300 to increase a clearance between the platen flange cover 202 and the platen 300.

Subsequently, as illustrated in FIG. 9B, the user closes the platen flange cover 202 to set the cloth 400 on the platen 300. The frame 202*b* of the platen flange cover 202 disposed above the hinge 203 serving as the fulcrum includes a rim 202*b*1 disposed in proximity to the hinge 203. Immediately before the rim 202*b*1 presses the cloth 400 against the platen 300, the rim 202*b*1 moves substantially horizontally in parallel to the platen 300 in a direction B, thus pressing the cloth 400 placed on the platen 300 inward in the longitudinal direction of the platen 300. Accordingly, the cloth 400 may be bent to produce a bulge 400*b*.

Subsequently, as illustrated in FIG. 9C, after the user closes the platen flange cover 202, the bulge 400*b* of the cloth 400 set on the platen 300 may remain as a crease.

If the cloth 400 set on the platen 300 creases, the print portion of the cloth 400 may have surface irregularities that degrade quality of an image printed on the cloth 400. Further, as the cloth 400 having the surface irregularities comes into contact with the head 122, the head 122 may stain the cloth 400 or may suffer from malfunction.

Figure 10:
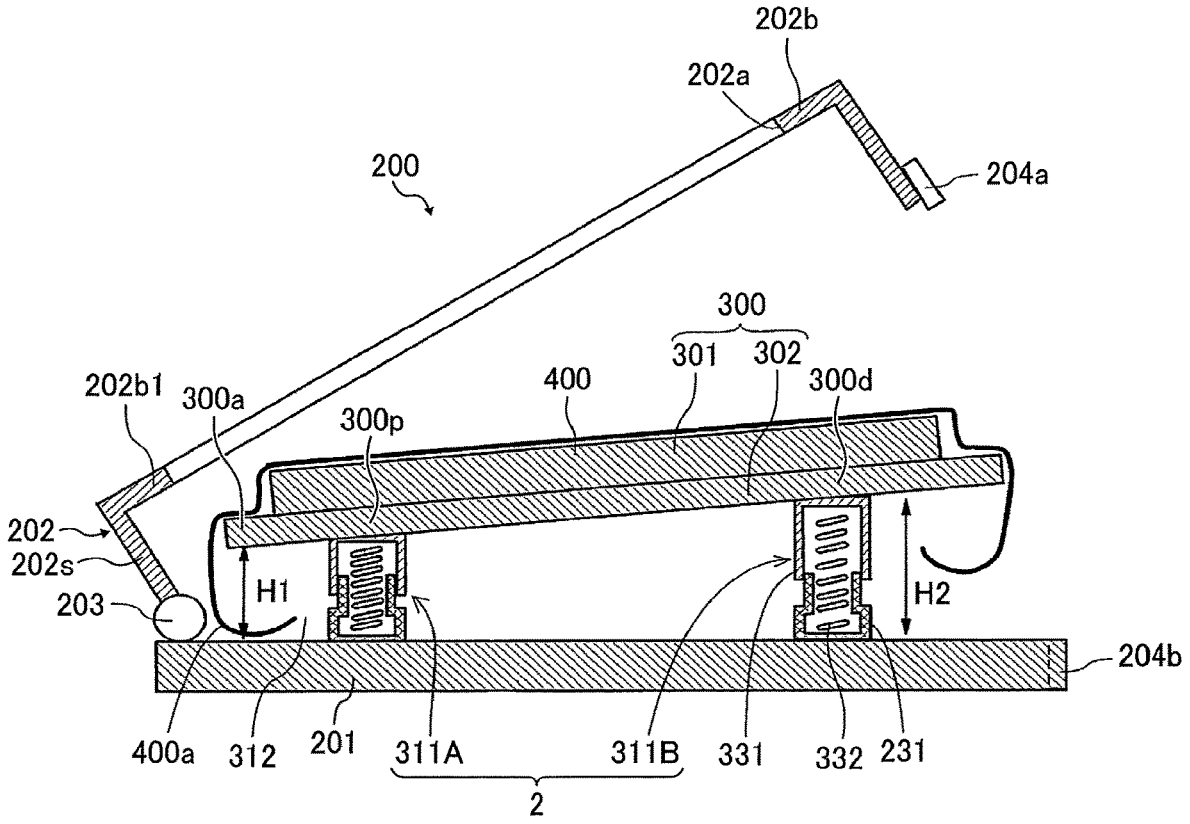
FIG. 10 is a schematic cross-sectional view of the cassette depicted in FIG. 1 according to a first embodiment, illustrating the platen flange cover that is lifted.

Referring to FIG. 10, a description is provided of a construction of the cassette 200 serving as a cloth holder according to a first embodiment.

FIG. 10 is a schematic cross-sectional view of the cassette 200 according to the first embodiment in the longitudinal direction thereof.

As illustrated in FIG. 10, a support 311B is disposed farther from the supported end 202*s* of the platen flange cover 202 in the longitudinal direction of the cassette 200 than a support 311A is. While the platen flange cover 202 is lifted or opened, a height of the support 311A is different from a height of the support 311B in a direction perpendicular to the longitudinal direction of the cassette 200. For example, the height of the support 311B is greater than the height of the support 311A. Accordingly, while the platen flange cover 202 is lifted or opened, the platen 300 tilts relative to the cassette base 201. Hence, the clearance H2 is greater than the clearance H1.

Conversely, while the platen flange cover 202 is lowered or closed, the platen 300 is parallel to the cassette base 201 as illustrated in FIG. 7. Hence, the clearance H2 is equivalent to the clearance H1.

While the platen flange cover 202 is lifted or opened, the platen 300 tilts such that one end of the platen 300 in the longitudinal direction thereof, that is, a proximal end 300*p* of the platen 300 that is in proximity to the hinge 203 is lower than another end of the platen 300 in the longitudinal direction thereof, that is, a distal end 300*d* of the platen 300 that is distal from the hinge 203 and opposite the proximal end 300*p*. In other words, the distal end 300*d* of the platen 300 is higher than the proximal end 300*p* of the platen 300.

Figure 11A:
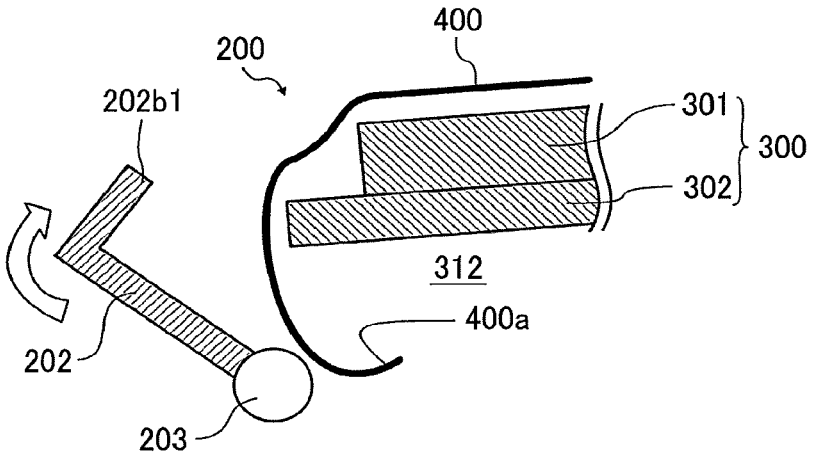
FIG. 11A is a partial cross-sectional view of the cassette depicted in FIG. 10, illustrating a first position of the platen flange cover.
Figure 11B:
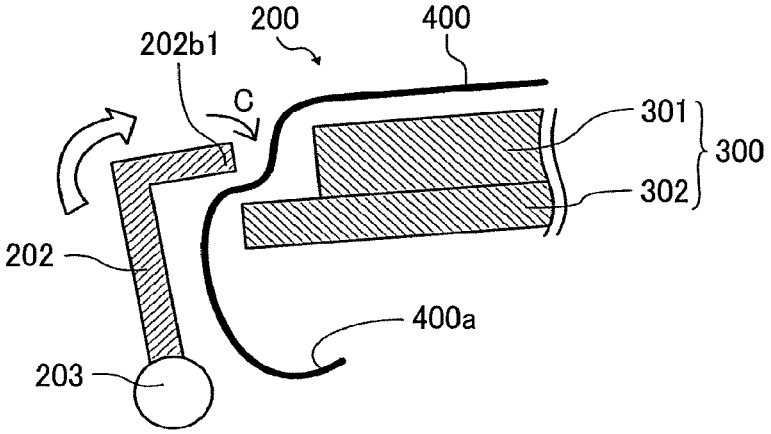
FIG. 11B is a partial cross-sectional view of the cassette depicted in FIG. 10, illustrating a second position of the platen flange cover.
Figure 11C:
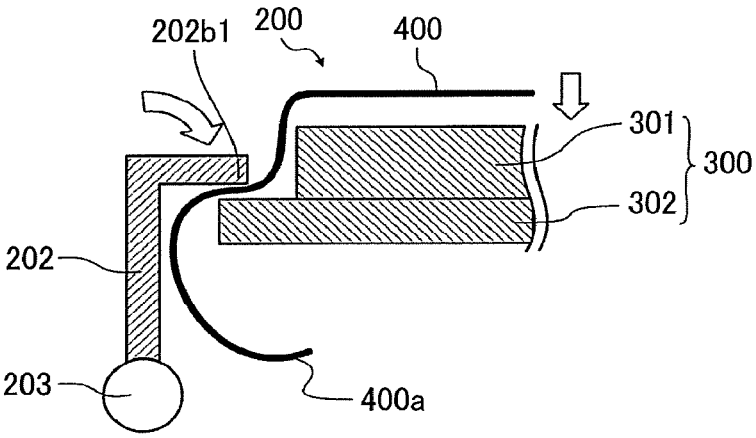
FIG. 11C is a partial cross-sectional view of the cassette depicted in FIG. 10, illustrating a third position of the platen flange cover.

Referring to FIGS. 11A, 11B, and 11C, a description is provided of processes for setting the cloth 400 on the platen 300 of the cassette 200 according to the first embodiment.

FIG. 11A is a partial cross-sectional view of the cassette 200, illustrating a first position of the platen flange cover 202 moved for the user to set the cloth 400 on the platen 300. FIG. 11B is a partial cross-sectional view of the cassette 200, illustrating a second position of the platen flange cover 202 moved for the user to set the cloth 400 on the platen 300. FIG. 11C is a partial cross-sectional view of the cassette 200, illustrating a third position of the platen flange cover 202 moved for the user to set the cloth 400 on the platen 300.

As illustrated in FIG. 11A, while the platen flange cover 202 is opened, the user places the cloth 400 on the platen 300 and places the surplus portion 400*a* of the cloth 400 that protrudes from the platen 300 into the accommodation chamber 312 below the platen 300. As described above with reference to FIG. 10, the distal end 300*d* of the platen 300 is higher than the proximal end 300*p* of the platen 300. Thus, the platen 300 tilts.

Subsequently, as illustrated in FIG. 11B, as the user lowers and closes the platen flange cover 202, unlike the rim 202*b*1 of the platen flange cover 202 of the comparative cassette 200C depicted in FIG. 9B described above, the rim 202*b*1 of the platen flange cover 202 of the cassette 200 does not move in substantially parallel to the platen 300. For example, the rim 202*b*1 moves in a direction C obliquely downward toward the platen 300 and hangs over the surplus portion 400*a* of the cloth 400.

That is, the platen flange cover 202 does not press the cloth 400 placed on the platen 300 toward a center of the platen 300 in the longitudinal direction thereof. Accordingly, as illustrated in FIG. 11C, after the user closes the platen flange cover 202, the platen flange cover 202 produces the appropriate, planar print portion of the cloth 400 without creases and irregularities when the cloth 400 is set on the platen 300. Thus, the supports 311A and 311B that tilt the platen 300 as illustrated in FIG. 10 serve as a cloth stretcher 2 that stretches the cloth 400 placed on the platen 300.

As described above, while the user sets the cloth 400 on the platen 300 of the cassette 200, the tilted platen 300 reduces creasing of the cloth 400 and resetting of the cloth 400, allowing the user to set the cloth 400 on the platen 300 readily and efficiently.

Figure 12:
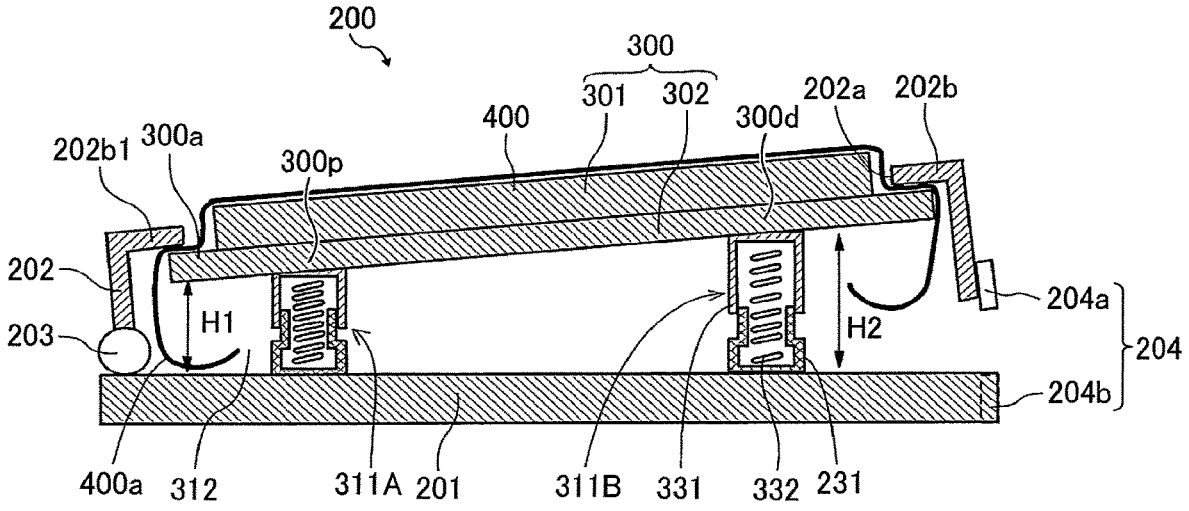
FIG. 12 is a schematic cross-sectional view of the cassette depicted in FIG. 10 in the longitudinal direction thereof.

FIG. 12 is a schematic cross-sectional view of the cassette 200 in the longitudinal direction thereof. As illustrated in FIG. 12, according to the first embodiment, the height of the support 311A is different from the height of the support 311B to tilt the platen 300. For example, the height of the support 311B that supports the distal end 300*d* of the platen 300 that is disposed in proximity to the lock 204 is higher than the height of the support 311A that supports the proximal end 300*p* of the platen 300 that is disposed in proximity to the hinge 203.

The lock 204 is disposed in proximity to the distal end 300*d* of the platen 300 that is opposite the proximal end 300*p* of the platen 300 that is disposed in proximity to the hinge 203. The lock 204 couples the platen flange cover 202 with the cassette base 201 and retains coupling of the platen flange cover 202 with the cassette base 201 to keep the platen flange cover 202 closed.

When the user opens the platen flange cover 202 that has been closed, since the distal end 300*d* of the platen 300 that is disposed in proximity to the lock 204 is lifted higher than the proximal end 300*p*, the user visually checks that the lock 204 is released readily. Additionally, when the user lifts the platen flange cover 202 further with his or her hand, the user accesses the platen flange cover 202 readily.

Figure 13A:
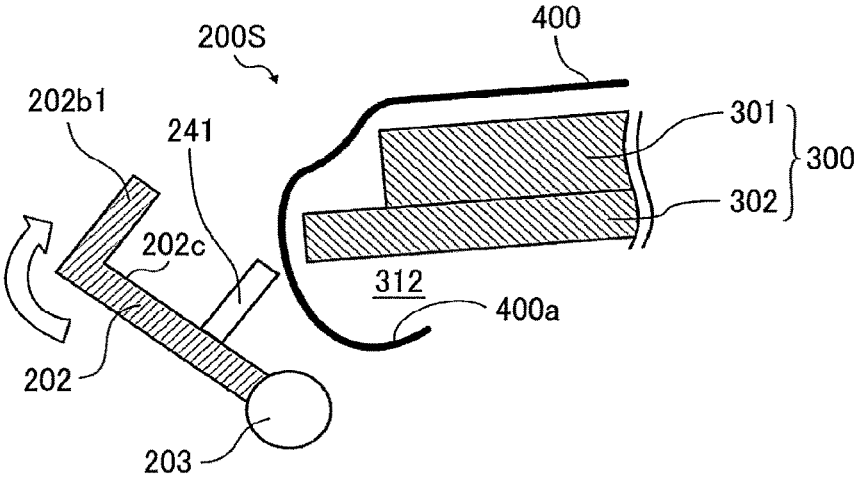
FIG. 13A is a partial cross-sectional view of a cassette according to a second embodiment that is installable in the printer depicted in FIG. 1, illustrating a first position of the platen flange cover.
Figure 13B:
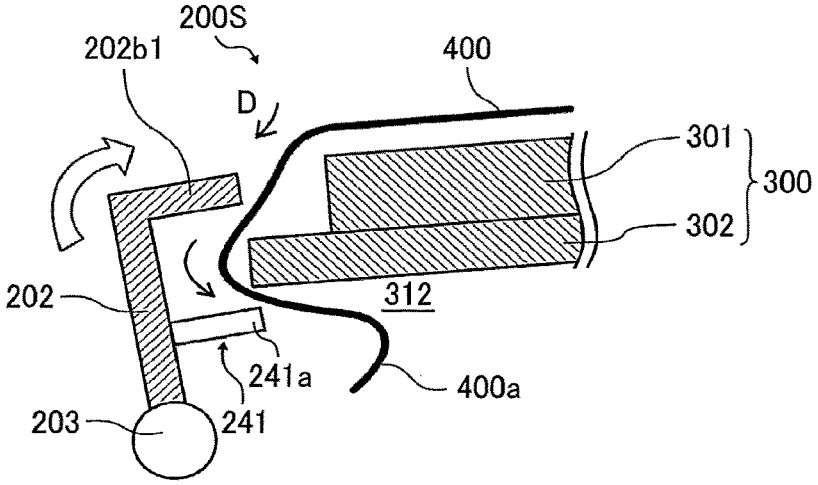
FIG. 13B is a partial cross-sectional view of the cassette depicted in FIG. 13A, illustrating a second position of the platen flange cover.
Figure 13C:
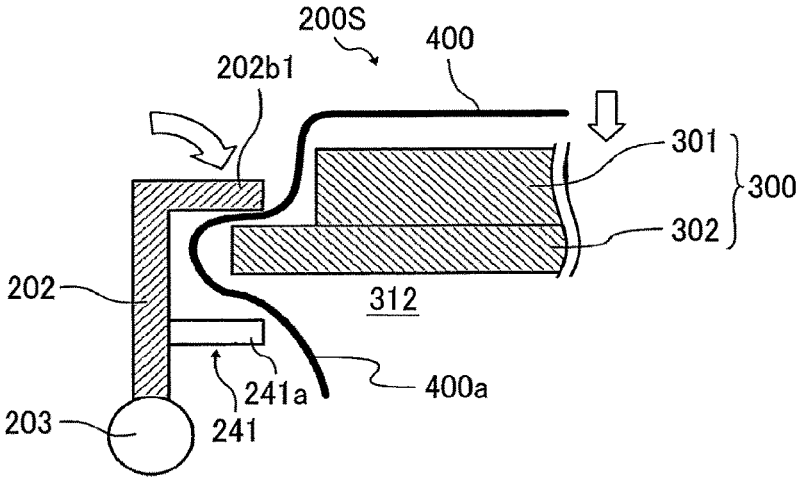
FIG. 13C is a partial cross-sectional view of the cassette depicted in FIG. 13A, illustrating a third position of the platen flange cover.

Referring to FIGS. 13A, 13B, and 13C, a description is provided of a construction of a cassette 200S serving as a cloth holder according to a second embodiment.

FIG. 13A is a partial cross-sectional view of the cassette 200S, illustrating a first position of the platen flange cover 202 moved for the user to set the cloth 400 on the platen 300. FIG. 13B is a partial cross-sectional view of the cassette 200S, illustrating a second position of the platen flange cover 202 moved for the user to set the cloth 400 on the platen 300. FIG. 13C is a partial cross-sectional view of the cassette 200S, illustrating a third position of the platen flange cover 202 moved for the user to set the cloth 400 on the platen 300.

As illustrated in FIGS. 13A, 13B, and 13C, the cassette 200S according to the second embodiment includes a presser 241 mounted on an interior face 202*c* of the platen flange cover 202. As illustrated in FIG. 13C, when the platen flange cover 202 is lowered or closed, the presser 241 moves to a position where the presser 241 is interposed between the platen 300 and the cassette base 201.

As illustrated in FIG. 13A, while the platen flange cover 202 is lifted or opened, the user places the cloth 400 on the platen 300 and places the surplus portion 400*a* of the cloth 400 that protrudes from the platen 300 into the accommodation chamber 312 below the platen 300.

Subsequently, as illustrated in FIG. 13B, when the platen flange cover 202 is lowered or closed, the presser 241 moves to the position where the presser 241 is interposed between the platen 300 and the cassette base 201. Accordingly, the presser 241 presses the surplus portion 400*a* of the cloth 400 toward the accommodation chamber 312.

While the platen flange cover 202 is lowered or closed, a front end 241*a* of the presser 241 and the platen 300 define a space therebetween toward which the presser 241 presses the cloth 400.

As illustrated in FIG. 13B, the presser 241 stretches the cloth 400 placed on the platen 300 in a direction D, suppressing creasing of the cloth 400.

Subsequently, as illustrated in FIG. 13C, after the user closes the platen flange cover 202, the cloth 400 set on the platen 300 is immune from creasing and has a plane without irregularities.

That is, as the presser 241 presses the surplus portion 400*a* of the cloth 400 into the accommodation chamber 312, the presser 241 serving as a cloth stretcher stretches the cloth 400 placed on the platen 300, suppressing creasing of the cloth 400.

Figure 14A:
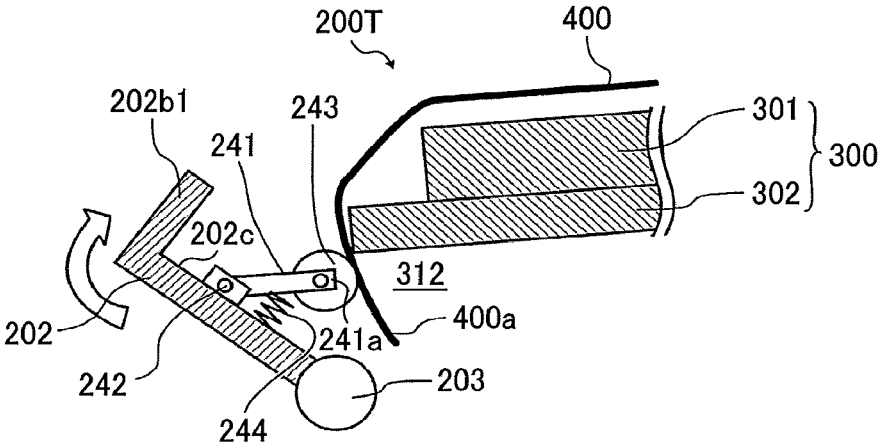
FIG. 14A is a partial cross-sectional view of a cassette according to a third embodiment that is installable in the printer depicted in FIG. 1, illustrating a first position of the platen flange cover.
Figure 14B:
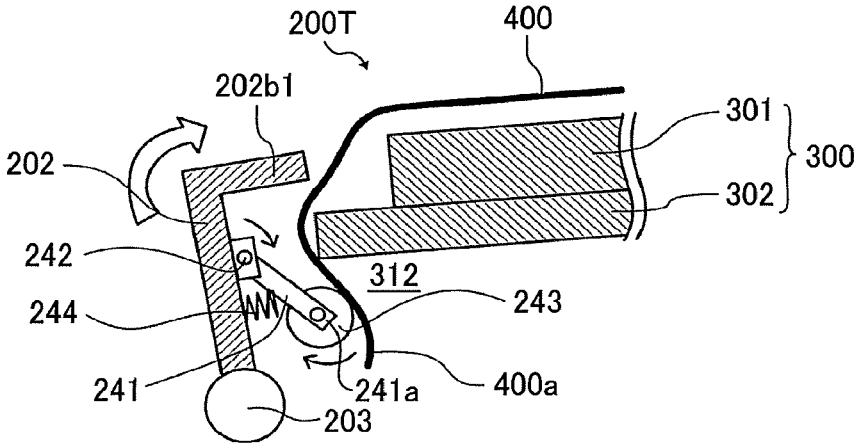
FIG. 14B is a partial cross-sectional view of the cassette depicted in FIG. 14A, illustrating a second position of the platen flange cover.
Figure 14C:
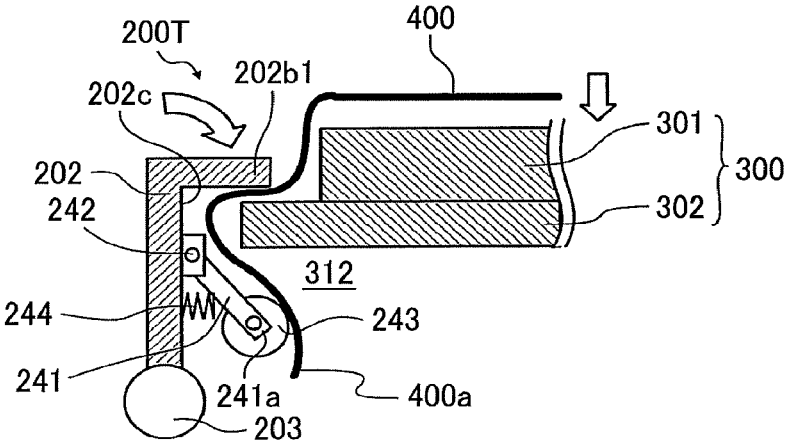
FIG. 14C is a partial cross-sectional view of the cassette depicted in FIG. 14A, illustrating a third position of the platen flange cover.

Referring to FIGS. 14A, 14B, and 14C, a description is provided of a construction of a cassette 200T serving as a cloth holder according to a third embodiment.

FIG. 14A is a partial cross-sectional view of the cassette 2001, illustrating a first position of the platen flange cover 202 moved for the user to set the cloth 400 on the platen 300. FIG. 14B is a partial cross-sectional view of the cassette 2001, illustrating a second position of the platen flange cover 202 moved for the user to set the cloth 400 on the platen 300. FIG. 14C is a partial cross-sectional view of the cassette 2001, illustrating a third position of the platen flange cover 202 moved for the user to set the cloth 400 on the platen 300.

As illustrated in FIGS. 14A, 14B, and 14C, the cassette 200T according to the third embodiment includes a shaft 242, a roller 243, and a resilient member 244. The shaft 242 is mounted on the interior face 202*c* of the platen flange cover 202. The shaft 242 pivotally supports the presser 241 such that the presser 241 is displaceable or movable relative to the platen flange cover 202. The front end 241*a* of the presser 241 rotatably supports the roller 243. The resilient member 244 (e.g., a compression spring) is anchored to and interposed between the presser 241 and the interior face 202*c* of the platen flange cover 202.

As illustrated in FIG. 14A, while the platen flange cover 202 is lifted or opened, the user places the cloth 400 on the platen 300 and places the surplus portion 400*a* of the cloth 400 that protrudes from the platen 300 into the accommodation chamber 312 below the platen 300.

Subsequently, as illustrated in FIG. 14B, when the platen flange cover 202 is lowered or closed, the roller 243 mounted on the front end 241*a* of the presser 241 enters the accommodation chamber 312 defined between the platen 300 and the cassette base 201 and presses the surplus portion 400*a* of the cloth 400 toward the accommodation chamber 312. The roller 243 stretches and pulls the cloth 400 placed on the platen 300 to the accommodation chamber 312, suppressing creasing of the cloth 400.

While the platen flange cover 202 is lowered and closed, the roller 243 mounted on the front end 241*a* of the presser 241 and the platen 300 define a space therebetween toward which the roller 243 presses the cloth 400.

Subsequently, as illustrated in FIG. 14C, after the user closes the platen flange cover 202, the cloth 400 set on the platen 300 is immune from creasing and has a plane without irregularities.

The presser 241 is displaceable or movable relative to the platen flange cover 202. The resilient member 244 exerts resilience to the presser 241 in a displacement direction thereof. Accordingly, when the presser 241 contacts the cloth 400 and presses the surplus portion 400*a* of the cloth 400 toward the center of the platen 300, that is, the accommodation chamber 312, even if the cloth 400 is thick and made of a material having a substantial reaction force, the presser 241 moves toward the interior face 202*c* of the platen flange cover 202 and escapes from the cloth 400.

When the cloth 400 is thick and imposes a substantial load on the presser 241 as the presser 241 presses the cloth 400 toward the accommodation chamber 312, the presser 241 displaces to avoid damage.

According to the third embodiment, the resilient member 244 exerts resilience to the presser 241. Alternatively, the presser 241 may be a flat spring that has resilience, for example.

When the platen flange cover 202 is lowered or closed, the front end 241*a* of the presser 241 may press the cloth 400 further after the front end 241*a* of the presser 241 comes into contact with the cloth 400 if the cassette 200T does not incorporate the roller 243. To address this circumstance, the cassette 200T incorporates the roller 243 that slides over the cloth 400, preventing the cloth 400 from being damaged.

As the roller 243 rotatably supported by the presser 241 comes into contact with the cloth 400, the roller 243 rotates. The roller 243 presses against the cloth 400 evenly throughout the entire width of the roller 243 in an axial direction thereof without catching the cloth 400, thus suppressing creasing of the cloth 400.

Alternatively, instead of mounting the roller 243, the presser 241 may have a shape having a curvature. For example, the presser 241 may include a round front end or a curved front end that comes into contact with the cloth 400.

Referring to FIGS. 15, 16A, 16B, and 16C, a description is provided of a construction of a cassette 200U serving as a cloth holder according to a fourth embodiment.

Figure 15:
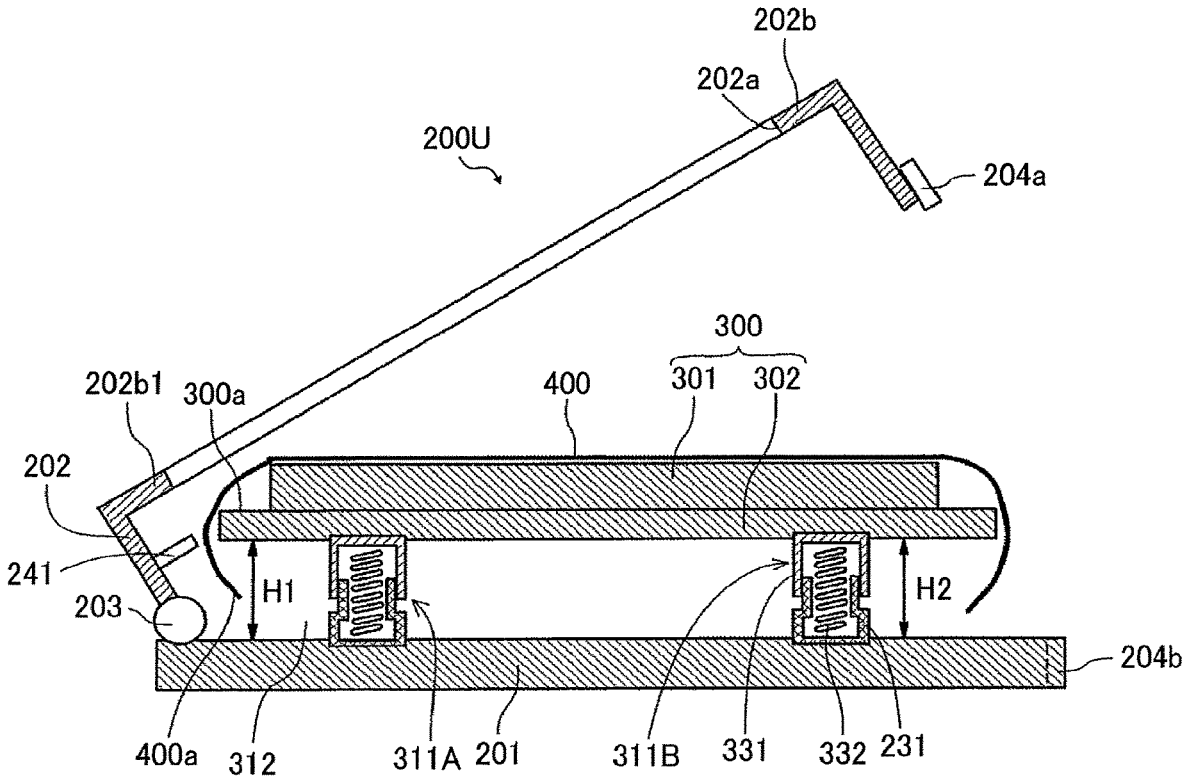
FIG. 15 is a schematic cross-sectional view of a cassette according to a fourth embodiment that is installable in the printer depicted in FIG. 1, illustrating the platen flange cover that is lifted.
Figure 16A:
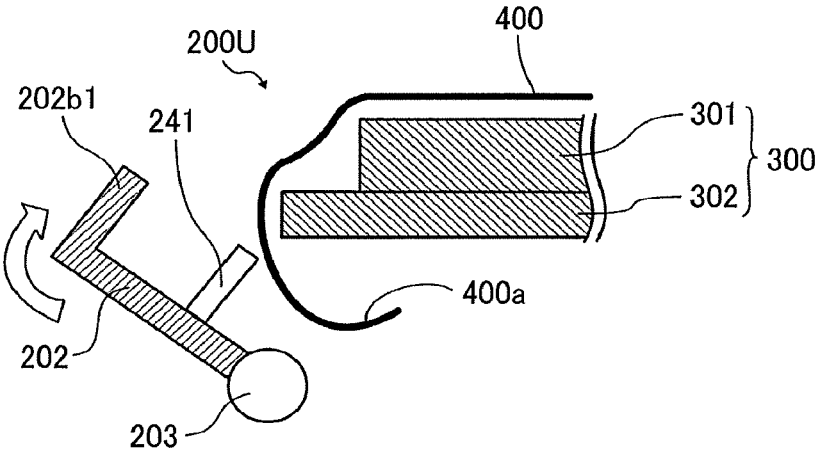
FIG. 16A is a partial cross-sectional view of the cassette depicted in FIG. 15, illustrating a first position of the platen flange cover.
Figure 16B:
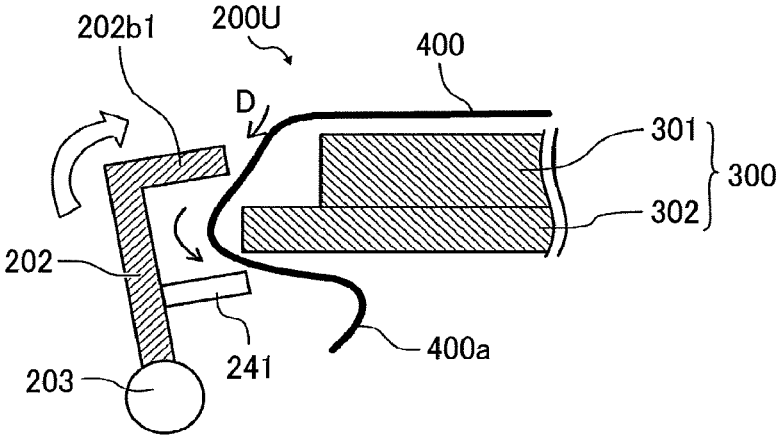
FIG. 16B is a partial cross-sectional view of the cassette depicted in FIG. 15, illustrating a second position of the platen flange cover.
Figure 16C:
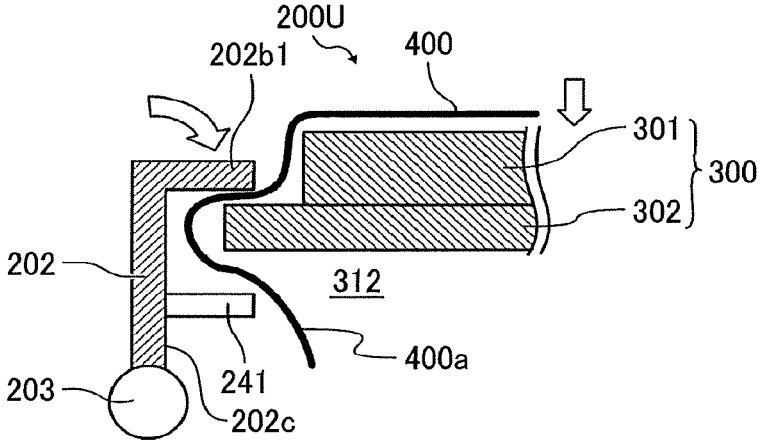
FIG. 16C is a partial cross-sectional view of the cassette depicted in FIG. 15, illustrating a third position of the platen flange cover.

FIG. 15 is a schematic cross-sectional view of the cassette 200U according to the fourth embodiment in a longitudinal direction thereof. FIG. 16A is a partial cross-sectional view of the cassette 200U, illustrating a first position of the platen flange cover 202 moved for the user to set the cloth 400 on the platen 300. FIG. 16B is a partial cross-sectional view of the cassette 200U, illustrating a second position of the platen flange cover 202 moved for the user to set the cloth 400 on the platen 300. FIG. 16C is a partial cross-sectional view of the cassette 200U, illustrating a third position of the platen flange cover 202 moved for the user to set the cloth 400 on the platen 300.

As illustrated in FIG. 15, while the platen flange cover 202 is lifted or opened, a height of the support 311A is equivalent to a height of the support 311B. Accordingly, whether the platen flange cover 202 is opened or closed, the platen 300 is parallel to the cassette base 201.

As illustrated in FIG. 16C, like the cassette 200S according to the second embodiment depicted in FIG. 13C, the cassette 200U includes the presser 241 mounted on the interior face 202*c* of the platen flange cover 202. When the platen flange cover 202 is lowered or closed, the presser 241 moves to a position where the presser 241 is interposed between the platen 300 and the cassette base 201.

Accordingly, as illustrated in FIGS. 16A, 16B, and 16C, like the presser 241 of the cassette 200S according to the second embodiment depicted in FIGS. 13A, 13B, and 13C, the presser 241 presses the cloth 400 toward the accommodation chamber 312, rendering the cloth 400 set on the platen 300 to be planar without creases and irregularities.

As illustrated in FIG. 15, while the platen flange cover 202 is lifted or opened, the platen 300 is configured to be parallel to the cassette base 201. Accordingly, the support 311A and the support 311B that support the platen 300 have an identical construction, simplifying the cassette 200U compared to the cassette 200S according to the second embodiment.

Figure 17:
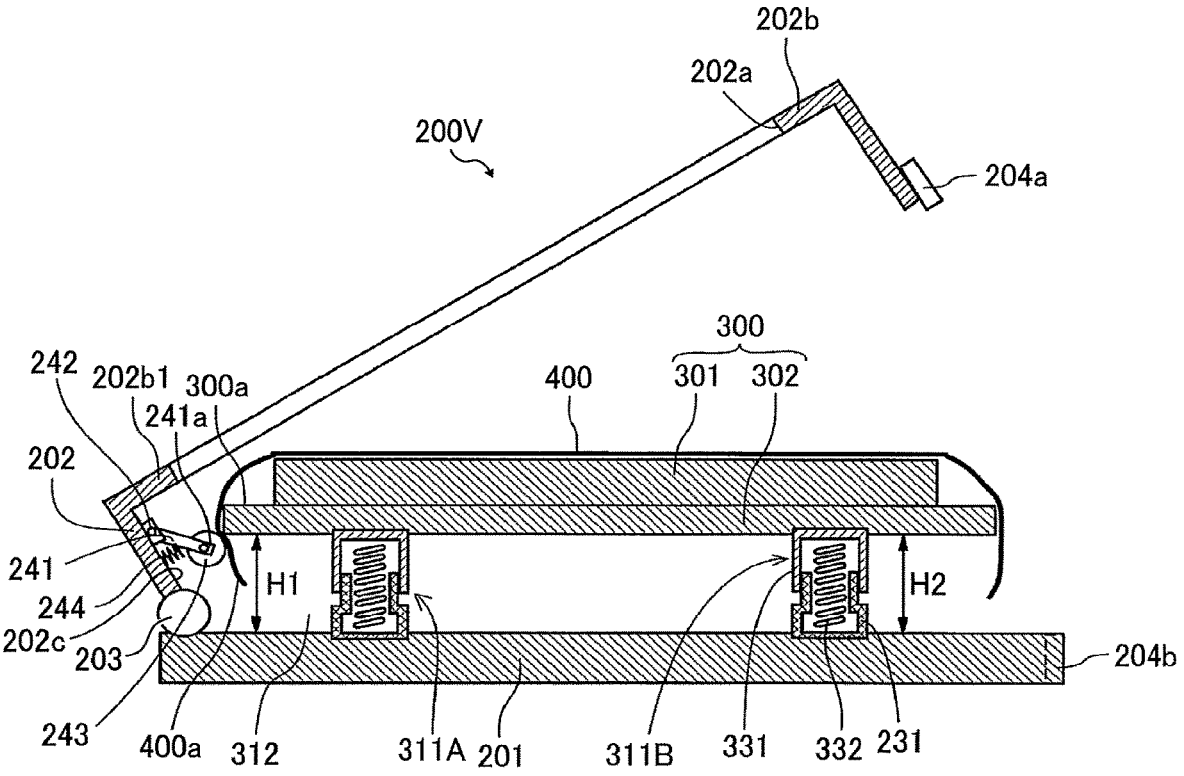
FIG. 17 is a schematic cross-sectional view of a cassette according to a fifth embodiment that is installable in the printer depicted in FIG. 1.

Referring to FIG. 17, a description is provided of a construction of a cassette 200V serving as a cloth holder according to a fifth embodiment.

FIG. 17 is a schematic cross-sectional view of the cassette 200V according to the fifth embodiment in a longitudinal direction thereof.

As illustrated in FIG. 17, while the platen flange cover 202 is lifted or opened, a height of the support 311A is equivalent to a height of the support 311B. Accordingly, whether the platen flange cover 202 is opened or closed, the platen 300 is parallel to the cassette base 201.

As illustrated in FIG. 17, like the cassette 200T according to the third embodiment depicted in FIG. 14C, the cassette 200V includes the presser 241 mounted on the interior face 202*c* of the platen flange cover 202. The shaft 242 is mounted on the interior face 202*c* of the platen flange cover 202. The shaft 242 pivotally supports the presser 241 such that the presser 241 is displaceable or movable. The front end 241*a* of the presser 241 rotatably supports the roller 243. The resilient member 244 (e.g., a compression spring) is anchored to and interposed between the presser 241 and the interior face 202*c* of the platen flange cover 202.

Accordingly, the cassette 200V according to the fifth embodiment attains advantages equivalent to those attained by the cassette 200T according to the third embodiment.

As illustrated in FIG. 17, while the platen flange cover 202 is lifted or opened, the platen 300 is configured to be parallel to the cassette base 201. Accordingly, the support 311A and the support 311B that support the platen 300 have an identical construction, simplifying the cassette 200V compared to the cassette 200T according to the third embodiment.

Figure 18:
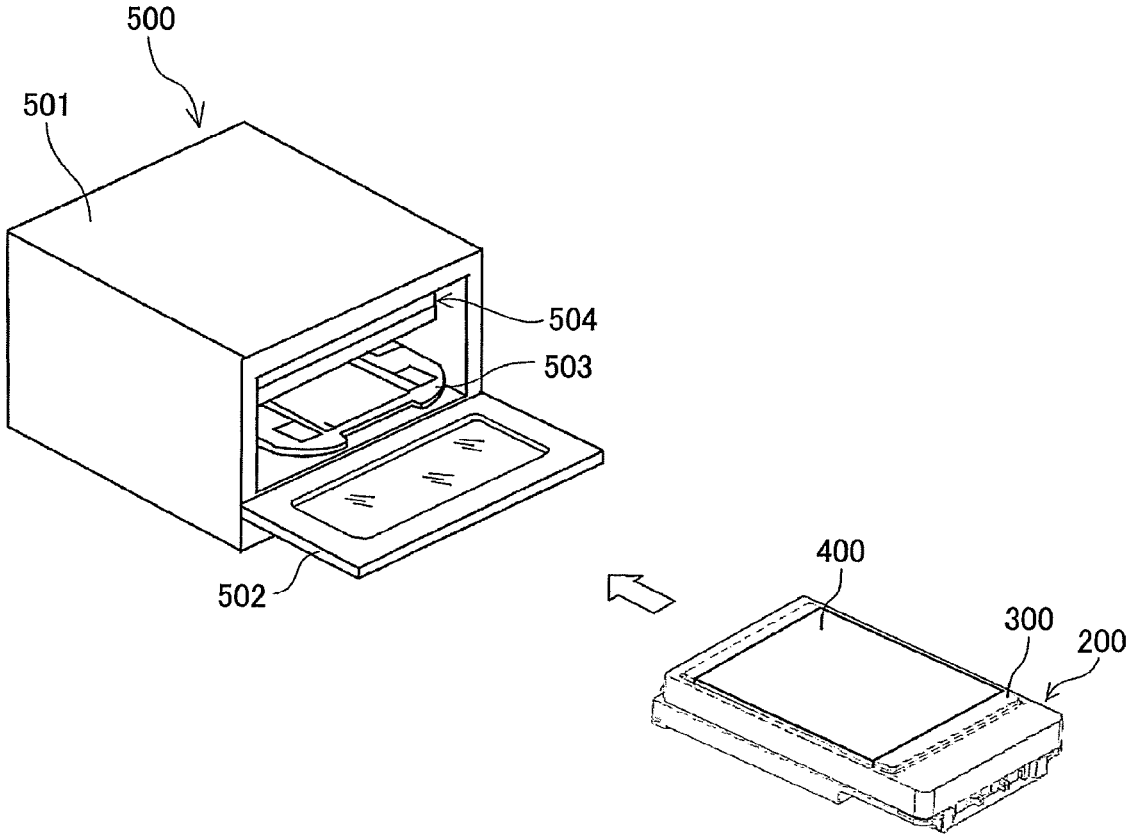
FIG. 18 is an external perspective view of a heating device and the cassette depicted in FIG. 1.

Referring to FIG. 18, a description is provided of one example of a construction of a heating device 500 that heats the cloth 400.

FIG. 18 is an external perspective view of the heating device 500.

As illustrated in FIG. 18, the heating device 500 includes a body 501, a door 502, a receiver 503, and a heater 504. The receiver 503 and the heater 504 are disposed inside the body 501. The cassette 200 that holds the cloth 400 is removably attached to the receiver 503. The heater 504 heats the cloth 400.

The receiver 503 has a construction equivalent to the above-described construction of the stage 111 of the printer 1. After the printer 1 finishes printing on the cloth 400, the user attaches the cassette 200 mounting the cloth 400 to the receiver 503 inside the heating device 500.

With the above-described construction of the heating device 500, after the printer 1 finishes printing on the cloth 400, the user removes the cassette 200 mounting the cloth 400 from the printer 1. The user sets the cassette 200 mounting the cloth 400 onto the receiver 503 disposed inside the heating device 500. While the door 502 is closed, as power is supplied to the heater 504 to generate heat, the heater 504 heats the cloth 400 set on the cassette 200 and fixes an image on the cloth 400.

A description is provided of processes for forming an image on a cloth 400.

In a holding process, the cassette 200 holds a cloth 400 onto which an image is to be formed. In a printing process, the cassette 200 mounting the cloth 400 is attached to the stage 111 of the printer 1 and the printer 1 prints the image on the cloth 400. In a heating process, after the printing process, the cassette 200 mounting the cloth 400 is removed from the printer 1 and attached to the heating device 500. The heating device 500 heats the cloth 400 and fixes the image on the cloth 400.

While the cassette 200 keeps mounting the cloth 400, the printer 1 prints the image on the cloth 400 and the heating device 500 fixes the image on the cloth 400 under heat, enhancing usability in forming the image on the cloth 400.

According to the embodiments described above, each of the cassettes 200, 200S, 200T, 200U, and 200V that has a box shape serves as a cloth holder. Alternatively, the cloth holder may have other shapes as long as the cloth holder is removably attached to a printer and a heating device. For example, the cloth holder may be a single platy platen to be inserted into the printer and the heating device.

As a method to enhance usability for printing, in order to eliminate a process in which the user sets a cloth (e.g., a T-shirt) on the cloth holder every time during printing, the user may use the cloth holder on which the cloth has been set. In this case, the cloth holder after use is collected and the cloth holder on which another cloth has been set is supplied.

Alternatively, in order to attain similar advantages, the user may use a platen on which a cloth (e.g., a T-shirt) has been set. The platen is removably attachable to the cloth holder. For example, the user attaches the platen mounting the cloth to the cloth holder. After printing and fixing are finished, the user removes the platen mounting the cloth from the cloth holder. The user attaches a next platen on which a cloth has been set to the cloth holder. Printing and fixing are performed on the cloth set on the next platen. In this case, the platen after use is collected and the platen on which another cloth has been set is supplied.

Accordingly, since the user need not set a cloth (e.g., a T-shirt) on the platen every time, the user readily handles a plurality of clothes continuously. Alternatively, the plurality of clothes may be automatically handled continuously.

The embodiments described above use fabric such as a T-shirt as the cloth 400. Alternatively, the embodiments described above are applicable to media including fabric on which an image is printed and heated. In this case, the cloth 400 used in the embodiments described above serves as a medium.

A description is provided of advantages of a cloth holder (e.g., the cassettes 200, 200S, 200T, 200U, and 200V).

As illustrated in FIG. 10, the cloth holder holds a cloth (e.g., the cloth 400) onto which an image is formed. The cloth holder includes a base (e.g., the cassette base 201), a platen (e.g., the platen 300), a flange cover (e.g., the platen flange cover 202), and a cloth stretcher (e.g., the cloth stretcher 2 constructed of the supports 311A and 311B and the presser 241). The platen holds the cloth and keeps a print portion of the cloth where the image is to be printed to be planar. The platen includes a flange (e.g., the flange 300*a*) that sandwiches the cloth together with the flange cover. The base pivotally supports one end of the flange cover in a longitudinal direction of the cloth holder. The flange cover is opened and closed relative to the base. The cloth stretcher stretches the cloth placed on the platen while the flange cover is moved. For example, while the flange cover is opened, the platen tilts relative to the base.

Accordingly, the cloth holder facilitates setting of the cloth on the platen.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A cloth holder comprising:

a base;

a platen to hold a cloth, the platen being movable and including a flange;

a flange cover to sandwich the cloth together with the flange of the platen, the flange cover including a supported end in a longitudinal direction of the cloth holder that is pivotally supported by the base, the flange cover to be opened and closed relative to the base; and a cloth stretcher to stretch the cloth placed on the platen while the flange cover is moved, wherein the platen tilts relative to the base while the flange cover is opened.

2. The cloth holder according to claim 1, wherein the cloth stretcher includes:

a first support to support the platen, the first support having a first height in a direction perpendicular to the longitudinal direction of the cloth holder; and a second support to support the platen, the second support being disposed farther from the supported end of the flange cover in the longitudinal direction of the cloth holder than the first support is, the second support having a second height in the direction perpendicular to the longitudinal direction of the cloth holder.

3. The cloth holder according to claim 2, wherein the first height of the first support is equivalent to the second height of the second support while the flange cover is opened.

4. The cloth holder according to claim 2, wherein the second height of the second support is greater than the first height of the first support while the flange cover is opened.

5. The cloth holder according to claim 2, wherein each of the first support and the second support includes:

a first hollow column mounted on the base;

a second hollow column to contact the platen and movably engage the first hollow column; and a compression spring disposed between the first hollow column and the second hollow column.

6. A fabric printing apparatus comprising the cloth holder according to claim 1.

7. A heating device for heating a cloth bearing an image printed by a fabric printing apparatus according to claim 1.

8. A cloth holder comprising:

a base;

a platen to hold a cloth, the platen being movable and including a flange;

a flange cover to sandwich the cloth together with the flange of the platen, the flange cover including a supported end in a longitudinal direction of the cloth holder that is pivotally supported by the base, the flange cover to be opened and closed relative to the base; and a cloth stretcher to stretch the cloth placed on the platen while the flange cover is moved, wherein the cloth stretcher includes a presser, mounted on the flange cover, to press the cloth toward a position interposed between the platen and the base when the flange cover is closed.

9. The cloth holder according to claim 8, wherein the flange cover and the flange of the platen sandwich the cloth to keep a print portion of the cloth where an image is to be printed to be planar.

10. The cloth holder according to claim 9, further comprising:

an accommodation chamber defined between the platen and the base, wherein the presser presses a surplus portion of the cloth toward the accommodation chamber, the surplus portion being other than the print portion.

11. The cloth holder according to claim 8, wherein the presser is movable relative to the flange cover.

12. The cloth holder according to claim 11, further comprising:

a shaft, mounted on the flange cover, to pivotally support the presser.

13. The cloth holder according to claim 12, further comprising:

a roller rotatably mounted on a front end of the presser.

14. The cloth holder according to claim 13, further comprising:

a resilient member, anchored to the presser and the flange cover, to exert resilience to the presser.

15. The cloth holder according to claim 14, wherein the resilient member includes a compression spring.

16. The cloth holder according to claim 8, further comprising:

a hinge through which the supported end of the cloth holder is pivotally supported by the base.

17. A fabric printing apparatus comprising the cloth holder according to claim 8.

18. A heating device for heating a cloth bearing an image printed by a fabric printing apparatus according to claim 8.

* * * * *